US007267256B2

(12) United States Patent
Kobayashi

(10) Patent No.: US 7,267,256 B2
(45) Date of Patent: Sep. 11, 2007

(54) MOTORIZED STAPLER

(75) Inventor: Hisashi Kobayashi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/535,983

(22) PCT Filed: Nov. 14, 2003

(86) PCT No.: PCT/JP03/14535

§ 371 (c)(1),
(2), (4) Date: May 24, 2005

(87) PCT Pub. No.: WO2004/048053

PCT Pub. Date: Jun. 10, 2004

(65) Prior Publication Data

US 2006/0086770 A1 Apr. 27, 2006

(30) Foreign Application Priority Data

Nov. 26, 2002 (JP) ..... 2002-343020

(51) Int. Cl.
*B27F 7/23* (2006.01)
*B27F 7/36* (2006.01)

(52) U.S. Cl. ..... 227/2; 227/111; 227/5; 227/131; 227/155

(58) Field of Classification Search ..... 227/2, 227/5, 111, 120, 129, 155, 131; 270/58.08, 270/58.09
See application file for complete search history.

(56) References Cited

U.S. PATENT DOCUMENTS 5,460,314 A * 10/1995 Udagawa ..... 227/155
5,791,543 A 8/1998 Udagawa et al.
5,791,548 A * 8/1998 Udagawa et al. ..... 227/131
5,806,750 A 9/1998 Yamanushi et al.
5,836,578 A * 11/1998 Hirano et al. ..... 270/58.11
5,951,000 A * 9/1999 Sato et al. ..... 270/58.11
5,975,396 A * 11/1999 Manabe ..... 227/2
RE36,923 E * 10/2000 Hiroi et al. ..... 227/2
6,223,965 B1 * 5/2001 Nakatsuka ..... 227/111
6,308,948 B1 * 10/2001 Azumi ..... 271/207
6,343,785 B1 * 2/2002 Yamada et al. ..... 270/58.08
6,607,188 B2 * 8/2003 Sato et al. ..... 270/58.09
6,641,024 B2 * 11/2003 Sato et al. ..... 227/155
6,644,643 B2 * 11/2003 Nonaka et al. ..... 270/58.08
7,014,183 B2 * 3/2006 Tamura et al. ..... 270/58.09
7,121,440 B2 * 10/2006 Kobayashi ..... 227/5

FOREIGN PATENT DOCUMENTS

JP 9-136302 5/1997
JP 9-136760 5/1997
JP 11-180619 7/1999

* cited by examiner

*Primary Examiner*—Rinaldi I. Rada
*Assistant Examiner*—Candace Brakewood
(74) *Attorney, Agent, or Firm*—Morgan, Lewis & Bockius LLP

(57) ABSTRACT

A driver unit 2 for striking out a staple, and a clincher unit 3 for clinching of legs of a staple are separated vertically from each other. The driver unit 2 and the clincher unit 3, respectively, are provided with drive motors M1, M2. Encoders 21, 40 are formed on respective drive shafts 12, 30, which drive the driver unit 2 and the clincher unit 3, to generate pulse signals P1, P2 upon rotation of the respective drive shafts. A control device 47 inputs thereinto the pulse signals P1, P2 to count the same, and the respective drive motors M1, M2 are controlled by the control device 47 on the basis of count values.

3 Claims, 12 Drawing Sheets

PRIOR ART

MOTORIZED STAPLER

TECHNICAL FIELD

The present invention relates to an electric stapler, in which a driver unit for striking out a staple and a clincher unit for bending legs of a staple are vertically separated from each other, drive motors are mounted on the respective units, and the respective drive motors drive a driver and a clincher mechanism.

BACKGROUND ART

Electric staplers accommodated inside, for example, a copying machine, a printing machine, or the like to bind a plurality of copied or printed sheets to be bound have been conventionally known. In such electric staplers, a driver unit for striking out a staple toward sheets, and a clincher unit for bending legs of a staple penetrated through sheets are vertically separated from each other and arranged to be spaced from each other, whereby sheets can pass between the respective units. In such electric staplers, after sheets are arranged between the respective units, the clincher unit is lowered toward sheets, as arranged in a bound position on a conveyance path whereby the sheets are clamped between the clincher unit and an upper surface of the driver unit, thereafter a driver of the driver unit is actuated to strike out a staple toward the clamped sheets. Thereafter, a clincher mechanism of the clincher unit is actuated to bend legs of the staple penetrated through the sheets along a back surface of the sheets so as to bind the sheets. Then, the respective units are driven to return to home positions separated from each other (see, for example, JP-A-09-136302).

In order to avoid a problem that respective drive mechanisms become complex and an apparatus becomes large in size because one drive motor drives a driver unit and a clincher unit with the use of a cam mechanism, a linkage, etc., JP-A-09-136302 discloses an electric stapler, which is made simple in mechanism and can be made small in size by providing exclusive drive motors on a driver unit and a clincher unit, respectively, using the drive motor of the driver unit to drive a driver, and using the drive motor of the clincher unit to move a clincher base of the clincher unit up and down and to actuate a clincher mechanism.

In order to drive the respective units with the exclusive drive motors on the respective units as described above, sensors arranged in respective portions detect signals at the time of termination of clamping by the clincher unit, termination of striking of a staple by the driver unit, and termination of clinching by the clincher unit, and driving and stoppage of the respective drive motors are controlled on the basis of the signals.

As shown in FIG. 12, the control device drives a drive motor m2 of the clincher unit on the basis of a start signal s1, which is given upon arrangement of sheets, in a bound position, to lower the clincher base to clamp between the same and an upper surface of the driver unit the sheets, stops the drive motor m2 of the clincher unit and drives a drive motor m1 of the driver unit on the basis of a sensor signal s2, which is given upon termination of clamping of the sheets, to actuate a driver to strike out a staple toward the sheets, as clamped, stops the drive motor m1 of the driver unit and again drives the drive motor m2 of the clincher unit on the basis of a sensor signal s3, which is given upon termination of striking of a staple, to bend those legs of a staple penetrated through the sheets, along a back surface of the sheets, so as to bind the sheets, drives the drive motor m1, m2 of the both units on the basis of a sensor signal s4, which is given upon termination of clinching, to return and actuate the respective units, and stops the respective drive motor m1, m2 on the basis of HP signals h1, h2 of the respective units to stop the respective units in home positions.

By the way, while according to the related art, at a point of time when clamping by the clincher unit is terminated, the drive motor m1 of the driver unit is driven to perform striking simultaneously when the drive motor m2 of the clincher unit is stopped, and at a point of time when striking is terminated, the drive motor m1 of the driver unit is stopped and the drive motor m2 of the clincher unit is again driven to actuate the clincher mechanism, there is caused a problem that starting generally takes time at the beginning of driving of a motor until the motor reaches a predetermined rotational speed, and a primary operation is not performed during the starting time, so that the necessary time in one cycle of staple binding is lengthened by periods L1, L2, L3 of starting time.

DISCLOSURE OF THE INVENTION

It is an object of the invention to solve the problem in the related art and to provide an electric stapler capable of shortening one-cycle operating time required for each staple binding performed by respective drive motors provided on a clincher unit and a driver unit.

In order to solve the problem, the embodiment of the invention provides an electric stapler comprising a driver unit provided with a driver that strikes out a staple toward sheets to be bound, a clincher unit arranged to be separated vertically from the driver unit and provided with a clincher base that holds a clincher mechanism to clinch legs of a staple penetrated through sheets, a driver drive motor provided on the driver unit to operate the driver, a clincher drive motor provided on the clincher unit to reciprocate the clincher base and to operate a clincher, a driver drive shaft that is rotated by the driver drive motor to actuate the driver, a clincher drive shaft that is rotated by the clincher drive motor to actuate the clincher mechanism and the clincher base, a driver drive shaft encoder that outputs a pulse signal upon rotation of the driver drive shaft, and a clincher drive shaft encoder that outputs a pulse signal upon rotation of the clincher drive shaft, and wherein the pulse signals are input into a control device to be counted, and starting/stoppage of the driver drive motor and the clincher drive motor is controlled on the basis of count values of the pulses.

Also, in the embodiment of the invention, the control device starts the driver drive motor when after driving of the clincher drive motor, pulses being counted, output from the clincher drive shaft encoder reach a predetermined number and before clamp operation by the clincher unit is terminated, and starts again the clincher drive motor of the clincher unit when after driving of the driver unit, pulses being counted, output from the driver drive shaft encoder reach a predetermined number and before a striking process of a staple by the driver unit is terminated.

Figure 1:
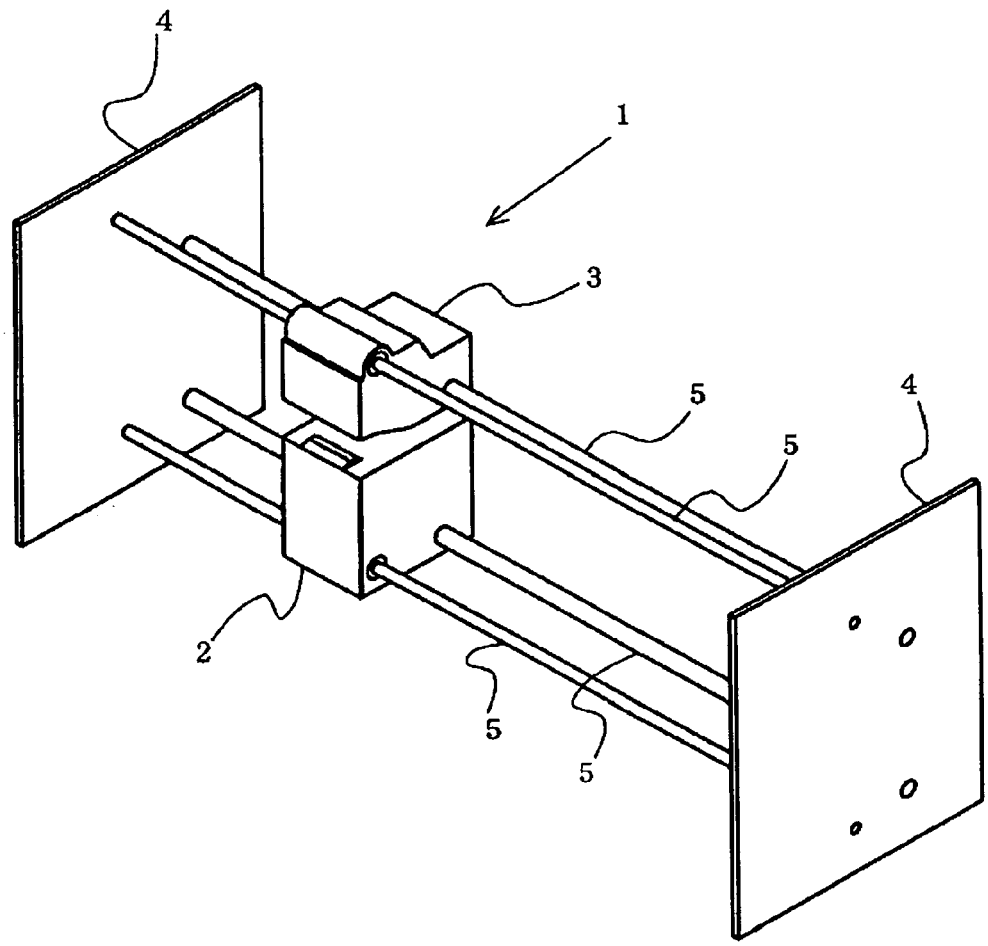
FIG. 1 is a perspective view showing an electric stapler according to an embodiment of the invention.

Note, in the drawings, the reference numeral 1 denotes an electric stapler, 2 a driver unit, 3 a clincher unit, 6 a striking mechanism, 8 a clincher mechanism, 9 a clincher base, 12 a driver drive shaft, 21 a driver drive shaft encoder, 22 a slit plate, 23 a photo-interrupter, 24 a light emitting diode, 25 a photodetector, 30 a clincher drive shaft, 40 a clincher drive shaft encoder, 41 a slit plate, 42 a photo-interrupter, 43 a light emitting diode, 44 a photodetector, 47 a control device, M1 a driver drive motor, and M2 a clincher drive motor.

BEST MODE FOR CARRYING OUT THE INVENTION

A mode for carrying out an electric stapler according to the invention will be described by way of an embodiment shown in the drawings. An electric stapler 1 is accommodated inside, for example, a copying machine, a printing machine, or the like to be provided midway a conveyance path, along which copied or printed sheets to be bound are conveyed, and comprises a driver unit 2 arranged on a lower surface side of the conveyance path and a clincher unit 3 arranged on an upper surface side of the conveyance path, as shown in FIG. 1. The driver unit 2 and the clincher unit 3 interpose therebetween the conveyance path of the sheets to be vertically separated from each other, are arranged in a state of being spaced away from each other so as to enable the sheets to pass between the both units 2, 3, and are supported so as to be able to move synchronously along guide shafts 5, which are installed between frames 4 arranged on both sides of the conveyance path, in a direction perpendicular to a direction of conveyance of the sheets.

Figure 2:
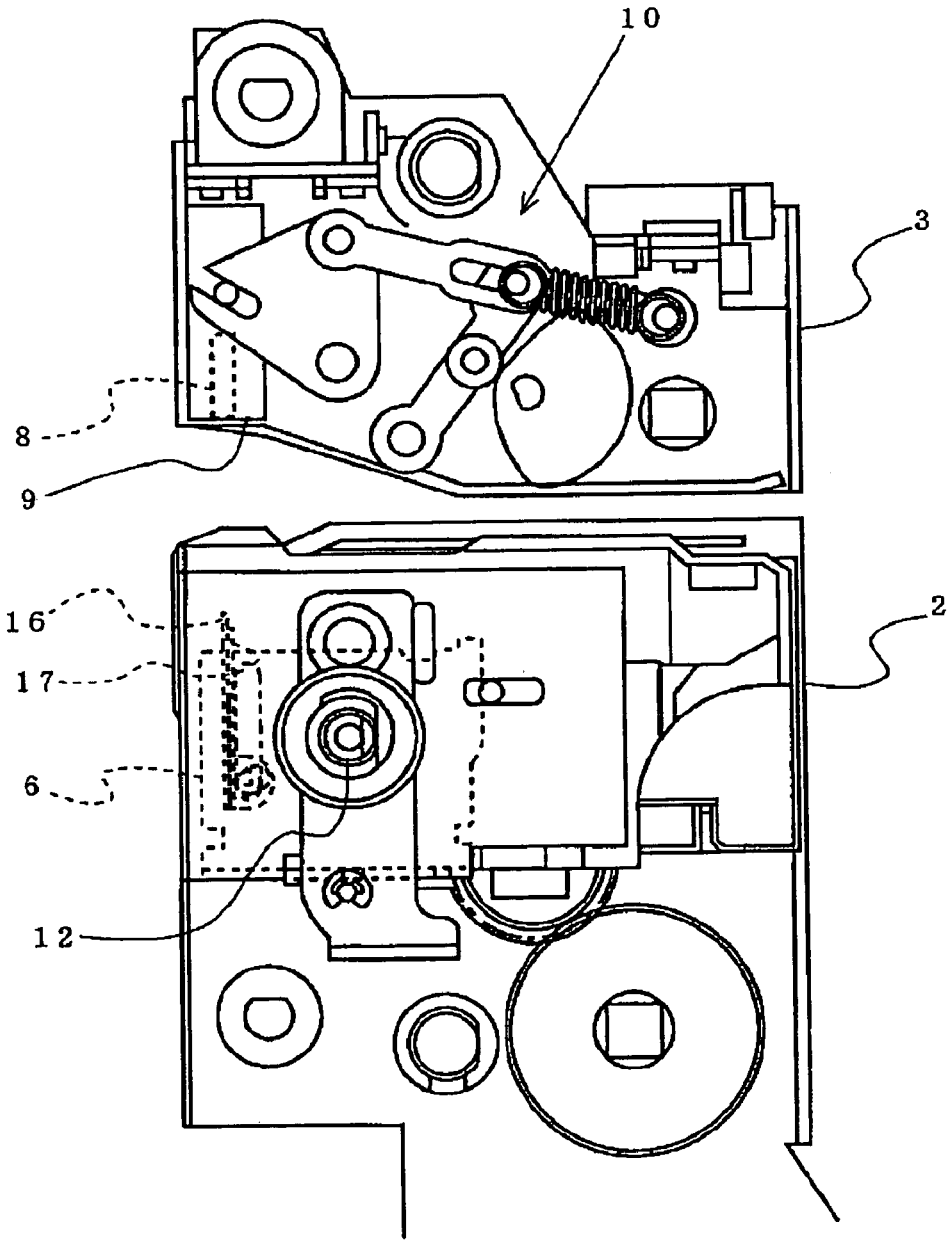
FIG. 2 is a side view showing the electric stapler of FIG. 1.

As shown in FIG. 2, the driver unit 2 comprises a feed mechanism (not shown), by which staples S stacked and accommodated in a cartridge mounted on a magazine (not shown) formed in the driver unit 2 are sequentially fed to a striking portion, a striking mechanism 6, by which a staple S fed to the striking portion is struck out toward sheets, the sheets being arranged on an upper surface side of the driver unit 2, and a drive mechanism 7 that drives the feed mechanism and the striking mechanism 6.

On the other hand, the clincher unit 3 comprises a clincher mechanism 8 that bends legs of a staple, which are struck out by the striking mechanism 6 to penetrate through the sheets, along a back surface side of the sheets, a clincher base 9 that holds the clincher mechanism 8 and can vertically move between a lower position, in which sheets are interposed between it and the driver unit 2, and an upper position, in which it separates from sheets, and a drive mechanism 10 that moves the clincher base 9 vertically and actuates the clincher mechanism 8.

Figure 3:
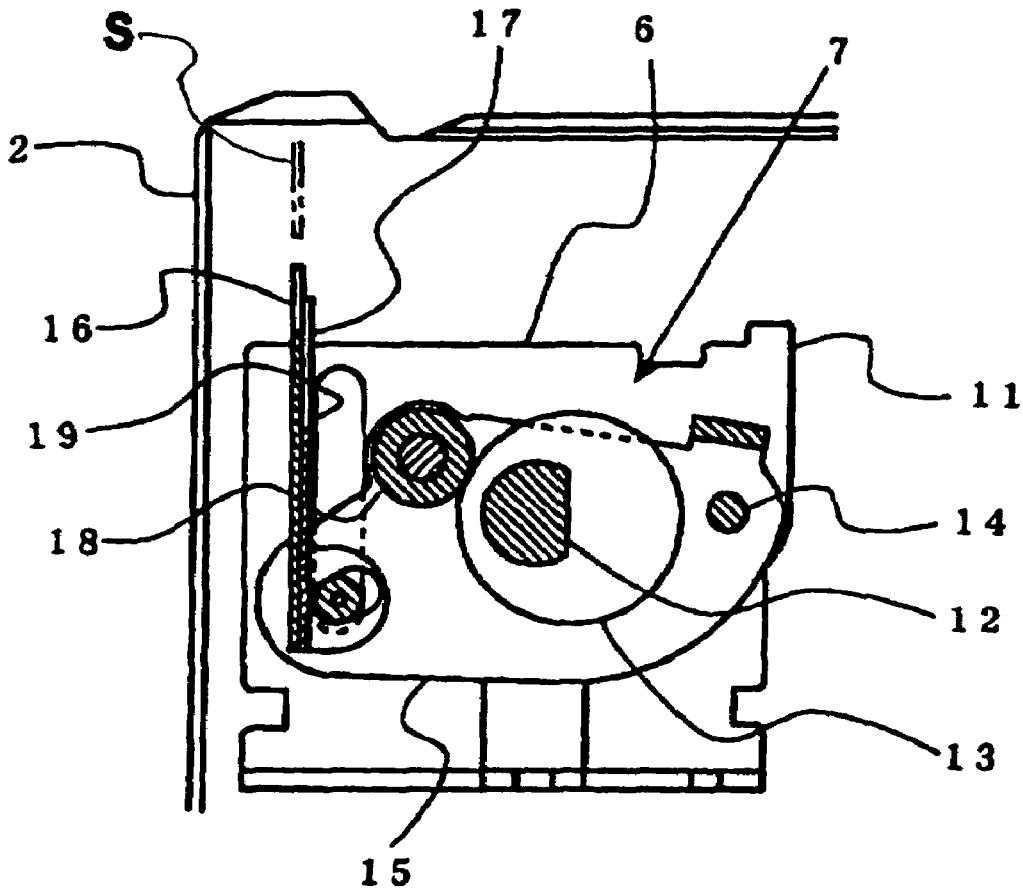
FIG. 3 is a cross sectional view showing a driver unit of the electric stapler of FIG. 1.
Figure 4:
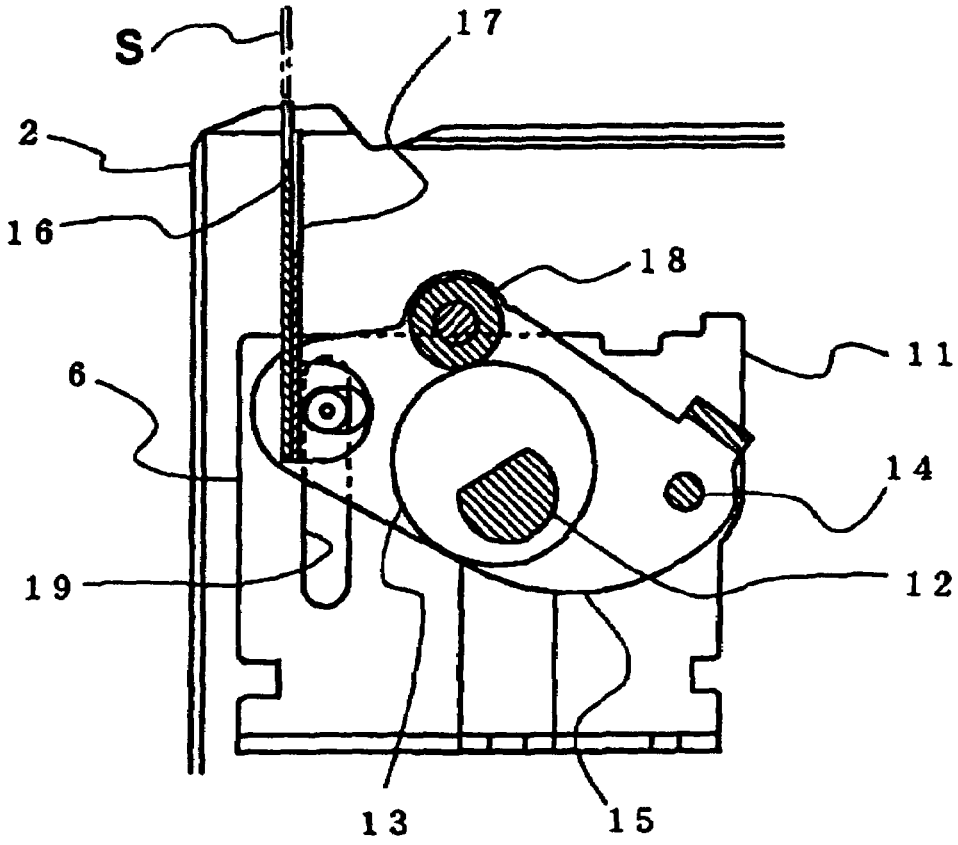
FIG. 4 is a cross sectional view showing a state, in which the driver unit of FIG. 3 operates.

The striking mechanism 6 provided in the driver unit 2 comprises, as shown in FIG. 3, a driver drive shaft 12 arranged to extend through a sub-frame 11 formed in the driver unit 2, a driver cam 13 mounted to the driver drive shaft 12, a driver link 15 pivotally mounted to the sub-frame 11 through a pivotal shaft 14, a driver 16 mounted to the driver link 15, a forming plate 17, and the like. A roller 18 is rotatably provided on the driver link 15, and the driver cam 13 rotates to cause the roller 18, which abuts against a peripheral surface of the driver cam 13, to turn the driver link 15 about the pivotal shaft 14, thereby moving the driver 16 and the forming plate 17 up and down along a slot 19 formed in the sub-frame 11, as shown in FIG. 4. That is, the driver cam 13 makes one revolution whereby the driver 16 and the forming plate 17 operate vertically in one reciprocation to form a staple to make the same C-shaped to strike out the same toward the sheets.

The drive mechanism 7 that actuates the striking mechanism 6 of the driver unit 2 comprises a driver drive motor arranged in the driver unit 2, a drive gear mounted on an output shaft of the motor, a reduction gear that meshes with the drive gear, and a driven gear 20 that meshes with the reduction gear and is mounted to one end of the driver drive shaft 12. The driver drive shaft 12 extends through side plates of the sub-frame 11 and both side plates of the frame, which forms the driver unit 2, to have both ends thereof projecting outside the side plates, and a driver drive shaft encoder 21 is formed on one end of the driver drive shaft 12 to generate pulse signals upon rotation of the driver drive shaft 12 as shown in FIG. 5.

Figure 5:
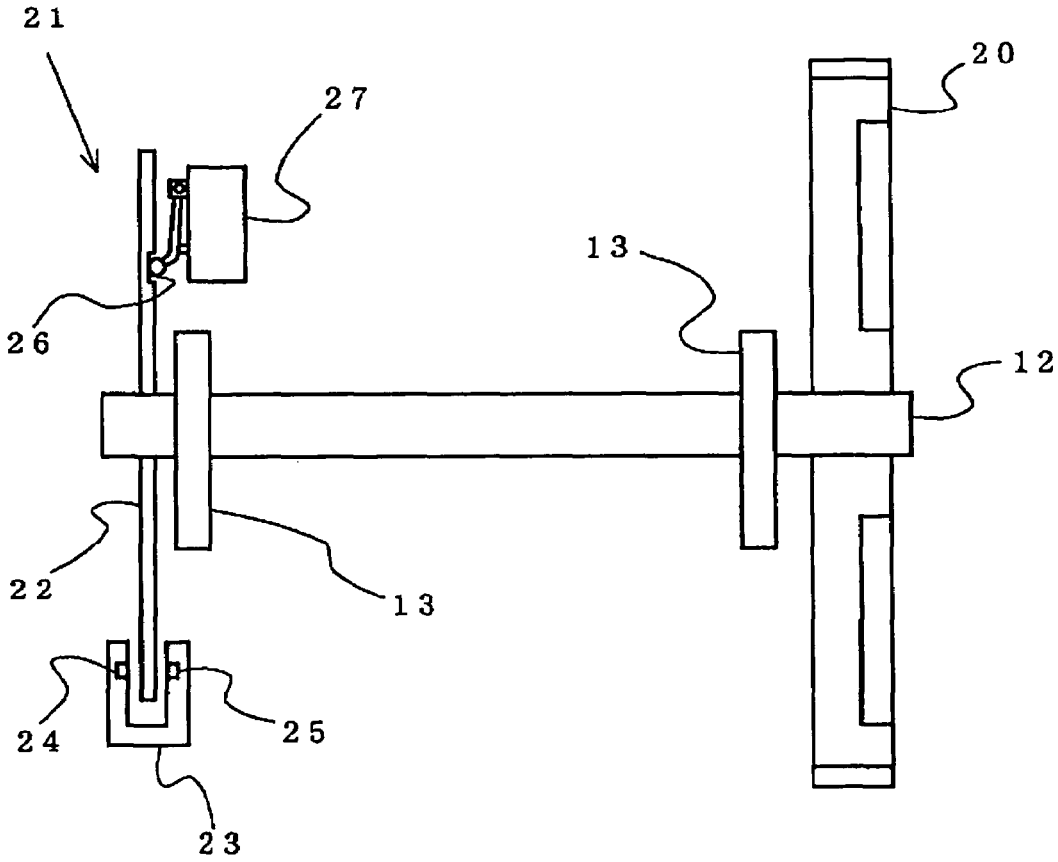
FIG. 5 is a cross sectional view showing a drive shaft of the driver unit of FIG. 3.

The driver drive shaft encoder 21 comprises, as shown in FIG. 5, a slit plate 22 mounted on the driver drive shaft 12 and formed with a plurality of slit holes arranged at predetermined intervals along a circumferential direction, and a photo-interrupter 23 composed of a light emitting diode 24 and a photodetector 25, which are arranged in opposition to each other with the slit plate 22 therebetween. The slit plate 22 is mounted integrally on the driver drive shaft 12, and the photo-interrupter 23 outputs driver pulse signals P1 as the driver drive shaft 12 rotates. A recess 26 is formed circumferentially in one location on a side of the slit plate 22 and a contact of a micro-switch 27 engages with the recess so that when the driver drive shaft 12 is rotated to a position, in which the driver 16 is arranged in an initial position, the micro-switch 27 outputs a driver HP signal H1.

Figure 6:
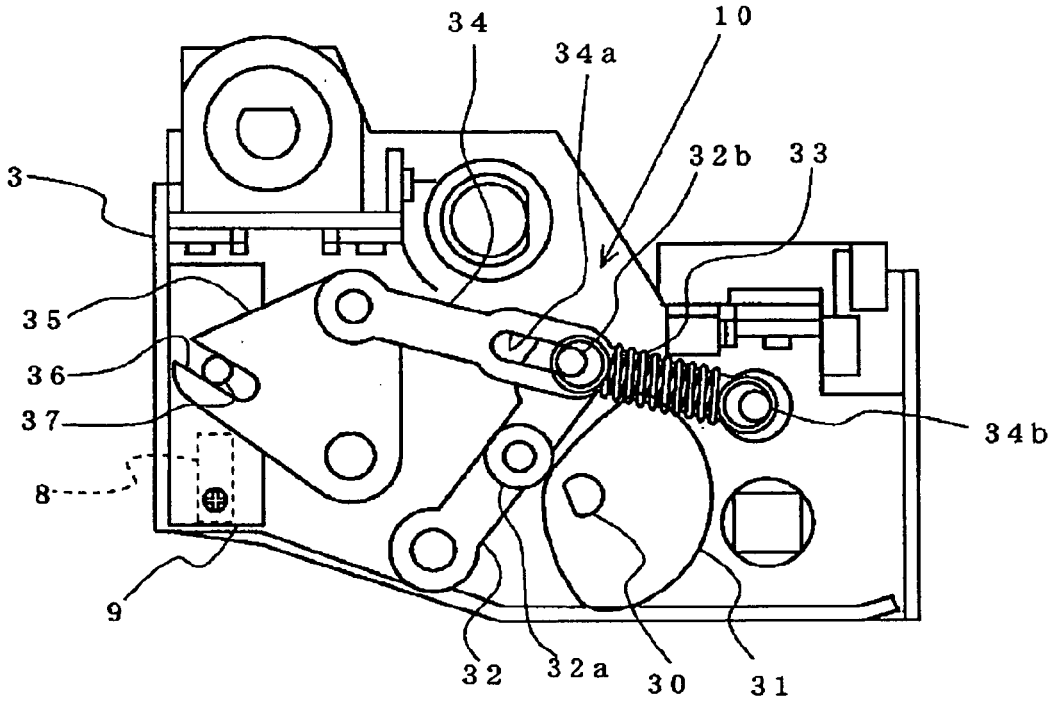
FIG. 6 is a cross sectional view showing a clincher unit of the electric stapler of FIG. 1.
Figure 7:
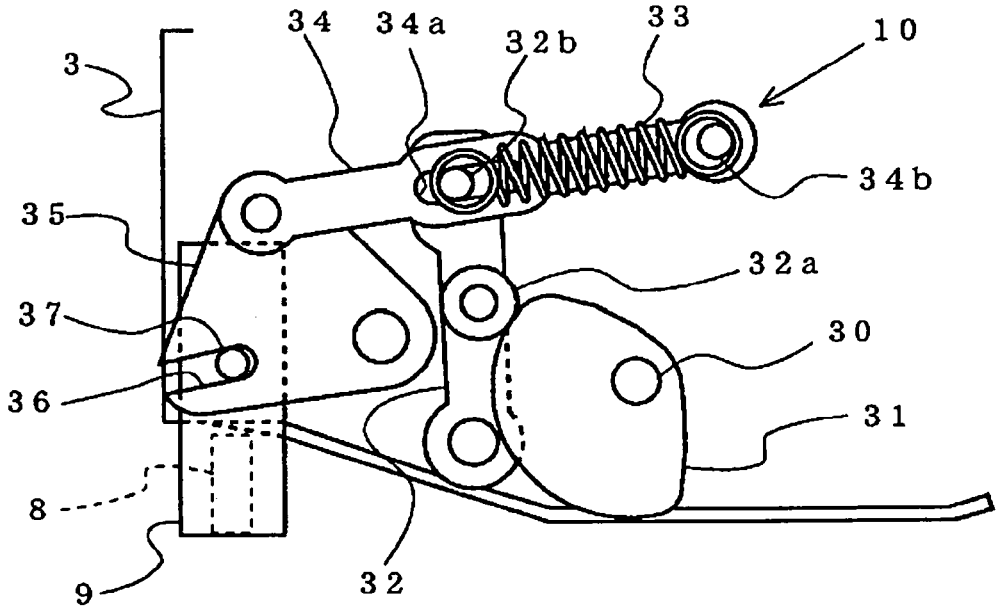
FIG. 7 is a cross sectional view showing a state, in which the clincher unit of FIG. 6 operates.

The drive mechanism 10 that vertically actuates the clincher base 9 provided in the clincher unit 3 comprises, as shown in FIG. 6, a drive cam 31 mounted on a drive shaft 30 rotationally driven by a motor (not shown), a first link 32 rotationally actuated by the drive cam 31, a second link 34 actuated through a tension spring 33 upon turning of the first link 32, and a turning link 35 turned by the second link 34. A roller 32*a* provided on an intermediate portion of the first link 32 abuts against a peripheral surface of the drive cam 31, and the drive cam 31 rotates to thereby turn the first link 32. Also, a shaft 32*b* provided on an upper portion of the first link 32 is loosely fitted into a slot 34*a* formed in an intermediate portion of the second link 34, and a tension spring 33 is stretched between the shaft 32*b* and a shaft 34*b* provided on a right end of the second link 34, so that turning movement of the first link 32 turned by the drive cam is transmitted to the tension spring 34 to turn the turning link 35 through the second link 34.

A pin 37 provided on the clincher base 9 is loosely fitted into a groove 36 formed in the turning link 35, and the turning link 35 is turned to actuate the clincher base 9 downward to interpose sheets P between a lower surface of the clincher base 9 and an upper surface of the driver unit 2. Accordingly, one revolution of the clincher drive shaft 30 causes the clincher base 9 to reciprocate once vertically.

Figure 8:
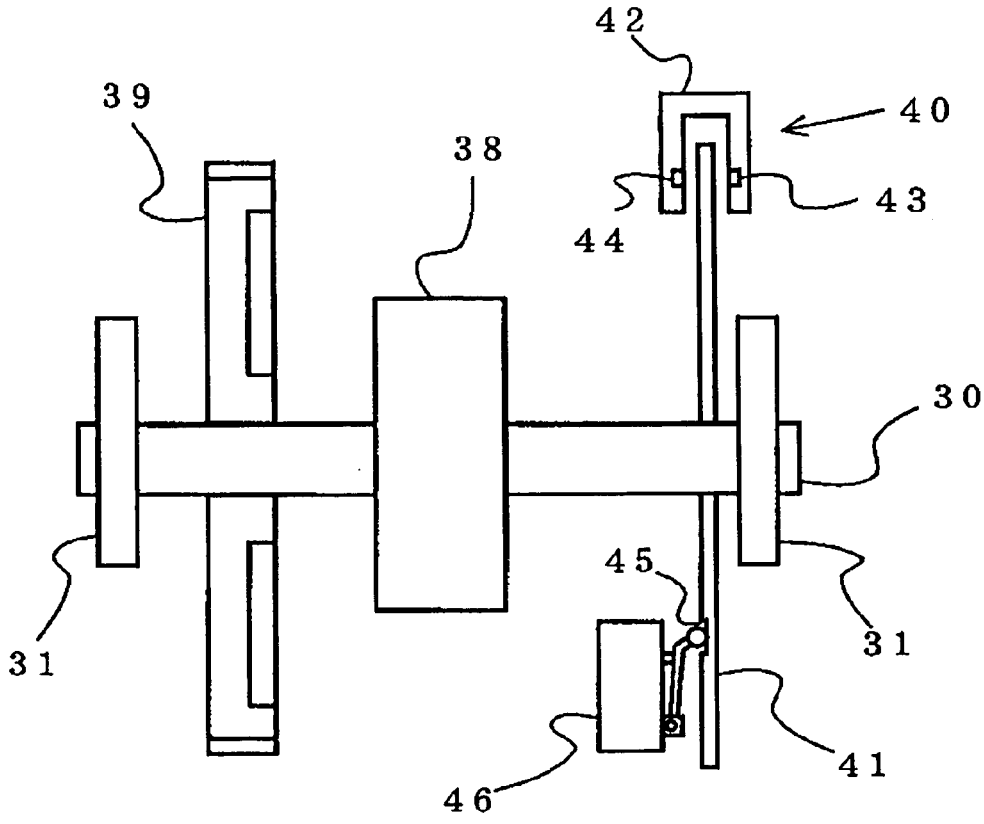
FIG. 8 is a cross sectional view showing a drive shaft of the clincher unit of FIG. 3.

The clincher mechanism 8 formed in the clincher base 9 is moved together with the clincher base 9 between an upper position, in which it separates from the sheets P, and a lower position, in which it approaches a top of the sheets, and while the clincher base 9 interposes the sheets P, between it and an upper surface of the driver unit 2, the clincher mechanism is actuated by a drive cam 38 mounted on the clincher drive shaft 30, through a linkage (not shown) to bend those legs of a staple S, which penetrate through the sheets P, along a back surface of the sheets, as shown in FIG. 8. The clincher drive shaft 30 is rotationally driven by a clincher drive motor M2 provided in the clincher unit 3, through a driven gear 39 mounted on the clincher drive shaft 30.

As shown in FIG. 8, an encoder 40 is formed on the clincher drive shaft 30 to generate clincher pulse signals P2 upon rotation of the clincher drive shaft 30. The clincher drive shaft encoder 40 comprises a slit plate 41 mounted on the clincher drive shaft 30 and formed with a plurality of slit holes arranged at predetermined intervals along a circumferential direction, and a photo-interrupter 42 composed of a light emitting diode 43 and a photodetector 44, which are arranged in opposition to each other with the slit plate 41 therebetween. The slit plate 41 is mounted integrally on the clincher drive shaft 30, and the photo-interrupter 42 outputs clincher pulse signals P2 as the clincher drive shaft 30 rotates. A recess 45 is formed circumferentially in one location on a side of the slit plate 41 and a contact of a micro-switch 46 engages with the recess so that when the clincher drive shaft 30 is rotated to a position, in which the clincher base 9 returns to an upper initial position, the micro-switch 46 outputs a clincher HP signal H2.

Figure 9:
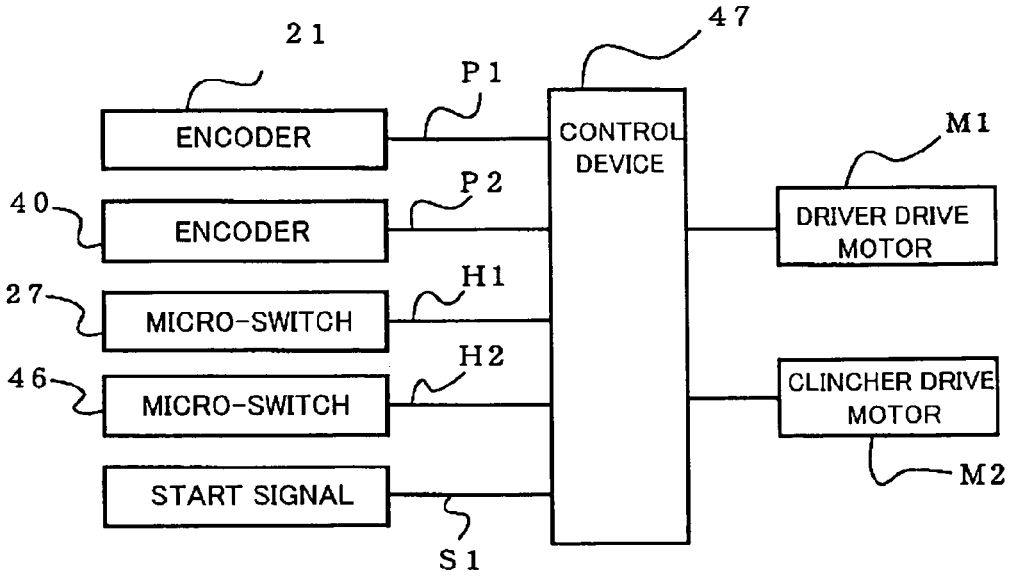
FIG. 9 is a block diagram illustrating a control system of the electric stapler of FIG. 1.

As shown in FIG. 9, a driver drive motor M1 provided in the driver unit 2 to drive the striking mechanism 3, and the clincher drive motor M2 provided in the clincher unit 3 to operate the clincher base 9 vertically and actuate the clincher mechanism 8 are controlled by a control device 47 composed of a CPU chip, or the like. Input into the control device 47 are driver pulse signals P1 and clincher pulse signals P2, which are output from the encoders 21, 40, a driver HP signal H1 and a clincher HP signal H2, which are output from the micro-switches 27, 46, and a start signal S1 for starting of the staple binding operation of the electric stapler, whereby the driver pulse signals P1 and the clincher pulse signals P2 are counted and driving and stoppage of the respective drive motors M1, M2 are controlled on the basis of the count number, the start signal S1, the driver HP signal H1, and the clincher HP signal H2.

Subsequently, an operation of the electric stapler 1 will be described with reference to FIGS. 10, 11(*a*), 11(*b*), 11(*c*), 11(*d*), and 11(*e*). In an initial state before the electric stapler 1 is actuated, both the striking mechanism 3 of the driver unit 2 and the clincher base 9 of the clincher unit 3 stand by in home positions, and contacts of the micro-switches 27, 46 engage with the recesses 26, 45 on the slit plates 22, 41 mounted on the respective drive shafts 12, 30 to output a driver HP signal H1 and a clincher HP signal H2 from the micro-switches 27, 46.

Figure 10:
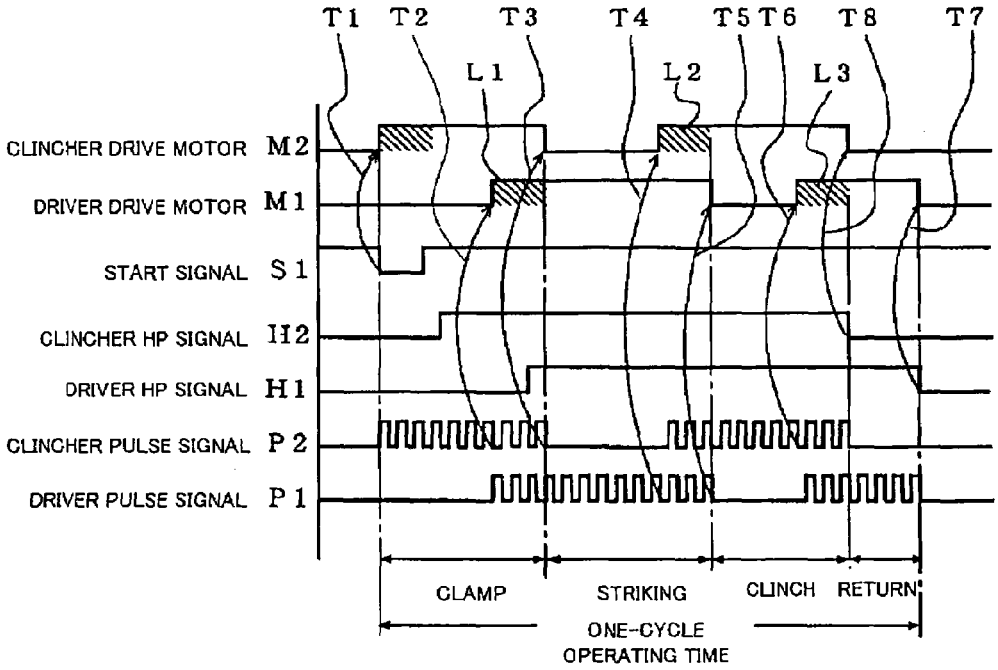
FIG. 10 is a control timing chart of drive motors in the control system of FIG. 9.
Figure 11A:
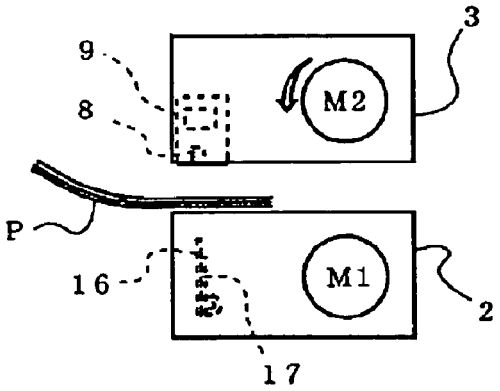
FIGS. 11(*a*), 11(*b*), 11(*c*), 11(*d*), and 11(*e*) are side views showing states, in which the electric stapler of FIG. 1 operates.
Figure 11B:
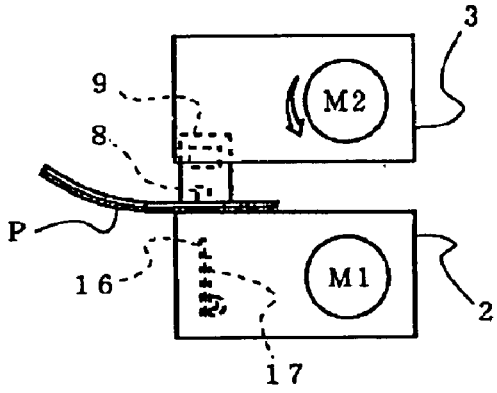
Figure 11C:
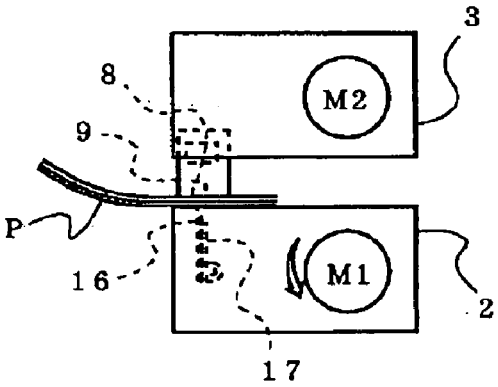
Figure 11D:
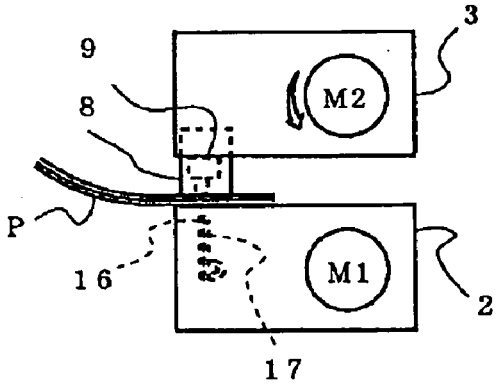
Figure 11E:
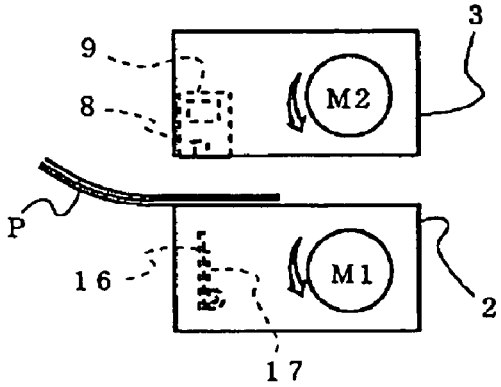
Figure 12:
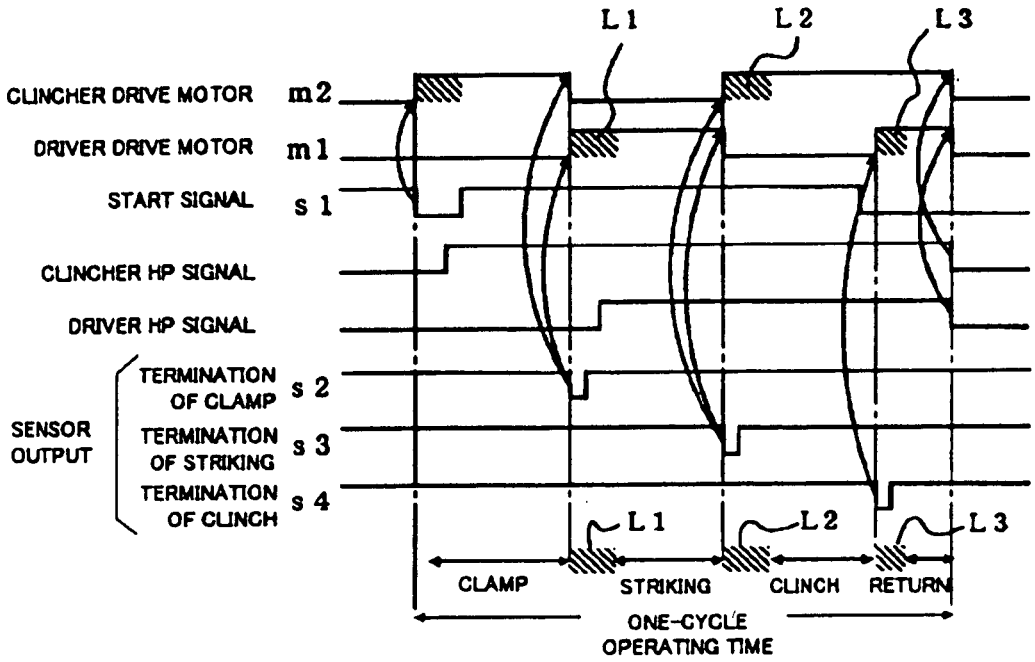
FIG. 12 is a control timing chart of drive motors in an electric stapler of the related art.

When the sheets P are set in a bound position and a start signal S1 is output from a copying machine or the like, the control device 47 drives the clincher drive motor M2 of the clincher unit 3 (T1 in FIG. 10). Driven by the clincher drive motor M2, the clincher drive shaft 30 is rotated to lower the clincher base 9 as shown in FIG. 11(*b*). At the same time, rotation of the clincher drive shaft 30 causes rotation of the slit plate 41, so that the clincher pulse signals P2 are output from the clincher drive shaft encoder 40 and the number of pulses is counted by the control device 47. Also, when the slit plate 41 is rotated a predetermined angle, the contact of the micro-switch 46 gets out of the recess 45 on the slit plate 41, so that the clincher pulse signals P2 output from the micro-switch 46 are released.

When the number of pulses of the clincher pulse signals P2 output from the clincher drive shaft encoder 40 reaches a predetermined number (T2 in FIG. 10), the control device 47 starts the driver drive motor M1 of the driver unit 2. The point T1 of time is before a point of time when clamping by the clincher unit 3 terminates, and a count value of pulses is set so that clamping terminates after a period of time L1 for starting of the driver drive motor M1 has elapsed. When the clincher base 9 descends a predetermined distance, the sheets P are clamped by the clincher base 9 and an upper end surface of the driver unit 2 as shown in FIG. 11(*b*). The control device 47 stops the clincher drive motor M2 according to a pulse count value (T3 in FIG. 10) at a point of time when clamping of the sheets P, by the clincher base 9 terminates.

The driver drive motor M1 of the driver unit 2 having already been driven rotates the driver drive shaft 12 to actuate the driver 16 as shown in FIG. 11(*c*) whereby a staple S formed to be made C-shaped is struck out toward the sheets P, having been clamped, to have legs of the staple S penetrating through the sheets P, to be exposed toward the clincher mechanism 8. During the operation of the driver 16, a staple being subsequently struck is formed by the forming plate 17 to be made C-shaped. Upon rotation of the driver drive shaft 12, driver pulse signals P1 are output from the driver drive shaft encoder 21, and the control device 47 counts the driver pulse signals P1 and starts again the clincher drive motor M2 of the clincher unit 3 when a count value of pulses reaches a predetermined number (T4 in FIG. 10). The point T4 of time is before a point of time when striking of a staple by the driver unit 2 terminates, and a count value of pulses is set so that striking of a staple terminates after a period of time L2 for starting of the clincher drive motor M2 has elapsed. The control device 47 stops the driver drive motor M1 according to a pulse count value (T5 in FIG. 10) at a point of time when striking of a staple by the driver 16 terminates.

The clincher drive motor M2 of the clincher unit 3 is again driven whereby the clincher mechanism 8 in the clincher base 9 is actuated to engage with those legs of a staple, which penetrate through the sheets, as clamped, to bend the legs along an upper surface of the sheets. Also, the clincher drive motor M2 of the clincher unit 3 is again driven whereby driver pulse signals P2 are output from the clincher drive shaft encoder 40, and the control device 47 counts the driver pulse signals P2 and starts again the driver drive motor M1 of the driver unit 2 at a point of time when a count value reaches a predetermined number (T6 in FIG. 10). The point T6 of time is before a point of time when clinch of a staple by the clincher mechanism 8 of the clincher unit 3 terminates, and a count value of pulses is set so that clinching of a staple terminates after a period of time L3 for starting of the driver drive motor M1 has elapsed.

When clinching of staple legs by the clincher mechanism 8 of the clincher unit 3 terminates, the clincher base 9 of the clincher unit 3 is actuated toward the upper home position by the drive mechanism 10. Also, the driver 16 and the forming plate 17 of the driver unit 2 are actuated toward the lower home positions. When the drive shafts 12, 30 of the respective units are rotated to the home positions, the recesses 26, 45 formed on the slit plates 22, 41 mounted on the respective drive shafts 12, 30 engage with the contacts of the micro-switches 27, 46, so that the micro-switches 27, 46 output a driver HP signal H1 and a clincher HP signal H2, respectively, and the control device 47 stops the driver drive motor M1 and the clincher drive motor M2, which drive the respective units 2, 3, on the basis of the HP signals H1, H2 (T7, T8 in FIG. 10).

INDUSTRIAL APPLICABILITY

As described above, according to the embodiment of the invention, since a driver drive motor and a clincher drive motor, respectively, are provided on a driver unit and a clincher unit to drive the units, encoders are formed on those drive shafts, which drive the respective units, to generate driver pulse signals upon rotation of the drive shafts, and a control device inputs the driver pulse signals thereinto to count the same and controls the drive motors in a manner to start/stop the same on the basis of the count values, it becomes possible to precedently start one of the drive motors without waiting for termination of a process in the other of the drive motors, thus enabling shortening an operating time in one cycle due to starting time in the respective drive motors.

The invention claimed is:

1. An electric stapler comprising:

a driver unit including a driver that strikes out a staple toward sheets to be bound;

a clincher unit arranged to be vertically separated from the driver unit and including a clincher base for holding a clincher mechanism that clinches legs of the staple penetrating through the sheets;

a driver drive motor on the driver unit for operating the driver, the driver drive motor being capable of being started and stopped;

a clincher drive motor on the clincher unit for reciprocating the clincher base and operating a clincher, the clincher drive motor being capable of being started and stopped;

a driver drive shaft rotated by the driver drive motor so as to actuate driver in a striking operation;

a clincher drive shaft rotated by clincher drive motor to actuate the clincher mechanism and the clincher base; and a driver drive shaft encoder that outputs a pulse signal upon rotation of the clincher drive shaft;

a clincher drive shaft encoder that outputs a pulse signal upon rotation of the clincher drive shaft, control means operatively connected to said driver drive shaft encoder and said clincher drive shaft encoder for counting said pulse signals, and wherein the control means starts the driver drive motor before a clamp operation by the clincher unit is terminated by stopping the clincher drive motor, when the control means has counted a predetermined number of pulse signals from the clincher drive shaft encoder after the clincher drive motor is started, and the control means starts again the clincher drive motor of the clincher unit before the striking operation of the staple by the driver unit is terminated by stopping the driver drive motor, when the control device has counted a predetermined number of pulse signals from the driver drive shaft encoder after the driver unit is started.

2. The electric stapler according to claim 1:

wherein the driver drive shaft rotates in a single direction to actuate the driver and return to an initial position, and the clincher drive shaft rotates in a single direction to actuate the clincher mechanism and return to an initial position.

3. The electric stapler of claim 2, wherein the driver drive shaft begins to rotate at the initial position, actuates the driver, and returns to the initial position in a single revolution.

* * * * *